US006602353B1

(12) United States Patent
Kanbe et al.

(10) Patent No.: US 6,602,353 B1
(45) Date of Patent: Aug. 5, 2003

(54) METHOD FOR NITRIDING-PROCESSING IRON GROUP SERIES ALLOY SUBSTRATE

(75) Inventors: Shigeaki Kanbe, Nagoya (JP); Hironori Hukuta, Nagoya (JP); Kousuke Katou, Nagoya (JP)

(73) Assignee: Cemm Co., Ltd., Aichi (JP)

( * ) Notice: Subject to any disclaimer, the term of this patent is extended or adjusted under 35 U.S.C. 154(b) by 8 days.

(21) Appl. No.: 09/857,183

(22) PCT Filed: Nov. 8, 2000

(86) PCT No.: PCT/JP00/07831

§ 371 (c)(1),
(2), (4) Date: Jun. 19, 2001

(87) PCT Pub. No.: WO01/34867

PCT Pub. Date: May 17, 2001

(30) Foreign Application Priority Data

Nov. 10, 1999 (JP) ..... 11-320108

(51) Int. Cl.[7] ..... C23C 14/34; C23C 8/36
(52) U.S. Cl. ..... 148/222; 204/298.33
(58) Field of Search ..... 148/222; 204/298.33

(56) References Cited

U.S. PATENT DOCUMENTS 3,593,400 A * 7/1971 Geiselman et al. .... 29/890.122
3,607,239 A * 9/1971 Mimino et al. ..... 420/54
5,271,823 A * 12/1993 Schachameyer et al. .... 205/224

FOREIGN PATENT DOCUMENTS

JP A-3-160187 7/1991
JP A-9-15383 1/1997

OTHER PUBLICATIONS

Pinedo et al, "Pulse Plasma Nitriding Treatment on Austenitic Stainles Steel 316", 1998, pub. by Associacao Brasileira de Metalurgia e Materials, 52$^{nd}$ (II Congresso Internacional de Tecnologia Metalurgica e de Materiais), pp. 151–161.*

* cited by examiner

*Primary Examiner*—Roy King
*Assistant Examiner*—Harry D. Wilkins, III
(74) *Attorney, Agent, or Firm*—Rader, Fishman & Grauer PLLC

(57) ABSTRACT

A processing method for nitriding an iron group series alloy substrate, or processing subject, containing an alloy element for forming nitride by plasma nitriding treatment including a passivated membrane removing treatment step. The passivated membrane removing treatment is performed by hydrogen sputtering under reduced pressure. It is desirable that this hydrogen sputtering is initiated from a normal temperature in a process of raising a temperature of a processing subject for plasma nitriding.

10 Claims, 8 Drawing Sheets

METHOD FOR NITRIDING-PROCESSING IRON GROUP SERIES ALLOY SUBSTRATE

TECHNICAL FIELD

The present invention relates to a method for nitriding-processing an iron group series alloy substrate (processing subject) containing an alloy element which easily forms a nitride by plasma nitriding.

Herein, Fe-base high alloy steel (containing a large amount of alloy elements) such as stainless steel, heat resistant steel (high nickel and high chromium steels) and the like is mainly explained but is not limiting. As used herein, "nitriding-treating" means only treating for forming a nitrided layer, and "nitriding-processing" means a process of a series of steps including nitriding-treating and pretreatment such as removal of a passivated membrane and the like.

A passivated membrane means a corrosion membrane and a passivated membrane of an oxidized membrane present on the surface of a substrate.

In addition, an iron group series alloy conceptionally contains not only an iron series alloy, a representative of which is steel containing mainly iron, stainless steel, but also superalloy such as Ni-base alloy and Cr-base alloy which has a base of an iron group other than iron (old 8 group 4 series ).

The shape of a substarate conceptionally contains not only original materials such as plate material, bar material and pipe material but also engine valve, stainless products, bolt, nut, cutting tool, mold and other machinery parts which are the form of product.

In addition, a temperature (atmosphere) denotes a gas temperature unless otherwise indicated.

BACKGROUND ART

Nitriding-processing as a means for improving mainly the resistance to abrasion and resistance to fatigue on the surface of high alloy steel such as stainless steel and the like is well known.

As nitriding-processing, a gas nitriding method of heating a steel in an ammonia gas, a salt bath nitriding method using cyanate (tufftriding method), and a plasma nitriding method (ion nitriding method) of holding a steel in nitrogen plasma utilizing glow discharge are frequently used (see ⌈Iwanami Physicochemistry Dictionary, 5th ed.⌋, published by Iwanami Shoten, 1998, p.841).

In nitriding-processing, a processing subject high alloy steel is provided with a passivated membrane (including a metal oxidized membrane and a corrosion membrane:hereinafter, simply referred to as ⌈passivated membrane⌋) resulting from self passivation due to production of an oxidized membrane of chromium or the like, and the passivated membrane inhibits nitriding-processing and, therefore, the passivated membrane needs to be removed before nitriding treatment.

As a means for removing the passivated membrane, a method using a chlorine series or fluorine series gas is adopted in a gas nitriding method. However, since those gases are corrosive, a gas nitriding apparatus itself is corroded and, therefore, there was a problem regarding stable treatment of a large amount of products. In addition, a salt bath nitriding (tufftriding method) using cyanate becomes problematic from a viewpoint of the earth environment.

Removal treatment and nitriding treatment for this passivated membrane have to be continuously done. When there is some time between passivated membrane removal and nitriding treatment, that is, when placed in an air, a passivated membrane is regenerated on a processing subject.

When the iron group series alloy substrate is nitriding-treated by plasma nitriding, a passivated membrane can be partially removed but it is stably removed with difficulty. As a means for improving it, argon sputtering is considered to be effective because the use of an atom having a large atomic weight generally exerts the better sputtering effect. A method for placing a cleaned processing subject in a plasma nitriding furnace and, thereafter, sputtering oxygen atoms by argon sputtering to remove a passivated membrane and performing nitriding has been utilized by some investigators.

However, it was found that this removing method can not remove a passivated membrane fully and stably in plasma nitriding processing. When removal of a passivated membrane is insufficient, it is difficult to obtain a nitrided layer of good quality by nitriding treatment. That is, it is difficult to obtain the required hardness of the surface and, at the same time, scatter of the surface hardness in a nitrided layer tends to occur.

In austenitic and precipitation hardening stainless steels and high alloy steels and superalloys containing a large amount of Cr, a firm passivated membrane is easily produced. For this reason, concerning these high alloy steels, it has been considered that a nitrided layer of stable quality is hardly obtained by nitriding treatment.

In addition, since the aforementioned argon sputtering can not be stably performed until a predetermined temperature (normally, a temperature near plasma nitriding treatment, for example 350° C.) is attained, it needs a time to raise a temperature to a temperature optimal for argon sputtering and, thus, nitriding-processing as a whole tends to need a longer time (see FIG. 1).

Further, a slight amount of water steam ($H_2O$) is usually contained in a nitrogen gas and an argon gas. The $H_2O$ is ionized by glow discharge in a plasma nitriding furnace, (hereinafter, simply referred to as ⌈nitriding furnace⌋ in some cases) and active oxygen is generated. The active oxygen contributes to regeneration of a passivated membrane and may inhibit removal of a passivated membrane.

In view of above circumstances, an object of the present invention is to provide a method for nitriding-processing an iron group series alloy substrate which can sufficiently remove a passivated membrane upon plasma nitriding of an iron group series alloy substrate and, as a whole, can assurely perform uniform nitriding-processing and, further, can perform nitriding-processing in a short period of time.

DISCLOSURE OF THE INVENTION

In view of the above circumstances, the present inventors studied intensively and found an unexpectedly high quality method for nitriding-processing an iron group series alloy substrate by plasma nitriding treatment, which has the essential features below and which can assurely remove a passivated membrane by hydrogen sputtering at a lower temperature range.

In a processing method for nitriding an iron group series alloy substrate (processing subject) by plasma nitriding treatment after pretreatment including passivated membrane removing treatment, said method comprises performing passivated membrane removing treatment by hydrogen sputtering under reduced pressure atmosphere.

It is desirable from a viewpoint of passivated membrane removability that the hydrogen sputtering is performed usually in the atmosphere at a temperature below 350° C., desirably in the atmosphere at a temperature below about 150° C.

It is more desirable from a viewpoint of quality stability and productivity that hydrogen sputtering is performed in the atmosphere at a temperature below 150° C. (usually normal temperature) in a process of raising a temperature of a processing subject in a plasma nitriding furnace.

It is desirable that a nitrided layer is formed at least initially by plasma nitriding treatment at a treatment temperature of 350 to 450° C. because a nitrided layer of stable quality is obtained when applied to austenitic stainless steel and the like.

In addition, it is desirable that the present nitriding-processing method is applied to an iron group series alloy substrate containing 3 wt % or more Cr as an alloy element because the effects of the present invention become remarkable.

BEST MODE FOR CARRYING OUT THE INVENTION

Figure 1:
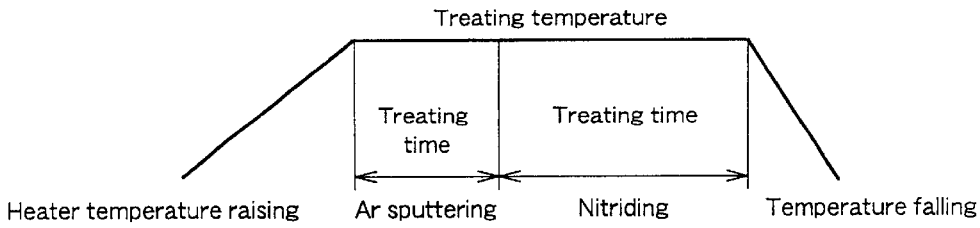
FIG. 1 is a model diagram showing an aspect of the previous plasma nitriding-processing.

Means in the present invention will be explained in detail below. In the following explanation, [%] which shows the composition means [% by mass] unless otherwise indicated.

The following explanation is premised on a processing method for nitriding an iron group series alloy substrate (processing subject) by plasma nitriding treatment after passivated membrane removing treatment.

Here, an iron group series alloy substrate contains not only Fe-base alloy steel and high alloy steel but also superalloys such as Cr-base alloy, Ni-base alloy and the like as described above.

Here, it is desirable that an iron group series alloy substrate contains an alloy element which contributes to increase in the hardness of a nitrided layer by formation of nitride. Thereby, it contributes to improvement in the surface hardness and the heat resistance in cooperation with iron nitride ($Fe_4N$ etc.) and, thus, high functional nitrided processed product can be obtained.

In addition, the alloy element includes chromium (Cr), aluminium (Al), molybdenum (Mo), vanadium (V) and the like.

Also nickel (Ni)hardly contributes to hardening concerning nitriding, in order to improve the nature of iron series alloys, it is used with the above alloy elements in many cases.

Examples of an iron series alloy include stainless steel (SUS), nickel chromium steel (SNC), nickel chromium molybdenum steel (SNMC), aluminium chromium molybdenum steel (SACM), corrosion resistant and heat resistant superalloy (NCF) and the like.

It is suitable that the present nitriding-processing method is applied to, inter alia, an iron group series alloy substrate containing 3% or more Cr as an alloy element, in particular, austenitic and precipitation hardening stainless steels as well as high alloy steels and superalloy containing a large amount (15% or more) of Cr because the remarkable effects are exerted, This is because a firm passivated membrane (oxidized membrane) is easily formed in these high alloy steels and removal thereof by argon sputtering is particularly difficult.

Even in martensitic and ferritic stainless steels, when the present nitriding-processing method is used, a nitrided layer of more stable quality is of course obtained as compared with the application of the previous technologies. The present method for nitriding-processing an iron group series alloy substrate will be explained in a step order below.

(1) Cleaning Treatment

Since an iron group series alloy substrate (including processing subject:product) is fundamentally manufactured by machine processing, a processing oil used at processing and other stains are adhered to the metal surface. In order to remove them, it is necessary to perform cleaning treatment in which degreasing treatment is conducted before passivated membrane removing treatment to remove stains (debris) which may inhibit normal nitriding.

As the degreasing treatment, so-called normal degreasing method can be used. For example, there are organic solvent degreasing with trichloroethylene, emulsion degreasing, heating alkali degreasing using an alkali degreasing solution, electrolytic degreasing and the like, and an aspect can be appropriately selected from spray washing, soaking, barrel washing and the like, if necessary.

(2) Passivated Membrane Removing Treatment

Figure 2:
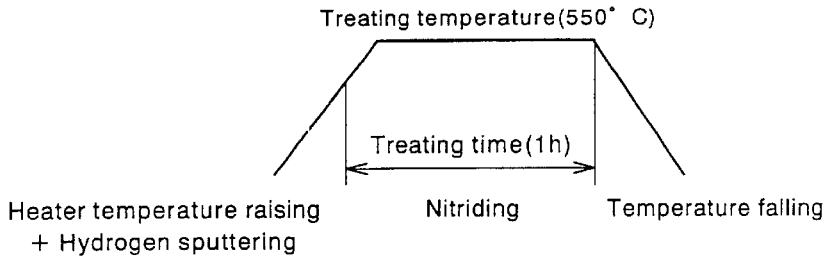
FIG. 2 is a model diagram showing an aspect of the present plasma nitriding-processing.

Present invention is most characterized in that hydrogen sputtering is used as passivated membrane removing method. Previously, it was common sense to a person skilled in the art that the use of hydrogen in sputtering exerts insufficient sputtering effects and the stability and the reproductively are deteriorated. However, the present inventors found that the above problems can be overcome by performing hydrogen sputtering in a low temperature range or from a low temperature range below nitriding treatment temperature, usually, below 350° C., desirably in a low temperature range or from a low temperature range below 150° C. as shown in FIG. 2, which resulted in completion of the present invention.

To explain more specifically, it is presumed that removal of a passivated membrane is conducted by the following mechanism: The plasma state for hydrogen is generated at a low temperature range in vacuum (under reduced pressure), hydrogen ion ($H^+$) in the plasma is hit against the surface of an iron group series alloy substrate (processing subject). Then, hydrogen ion becomes active hydrogen (H) in the atomic state, and passes through a passivated membrane (metal oxide) and enters into a substrate metal layer as a diffusive hydrogen (H)(FIG. 3 ←).

Figure 3:
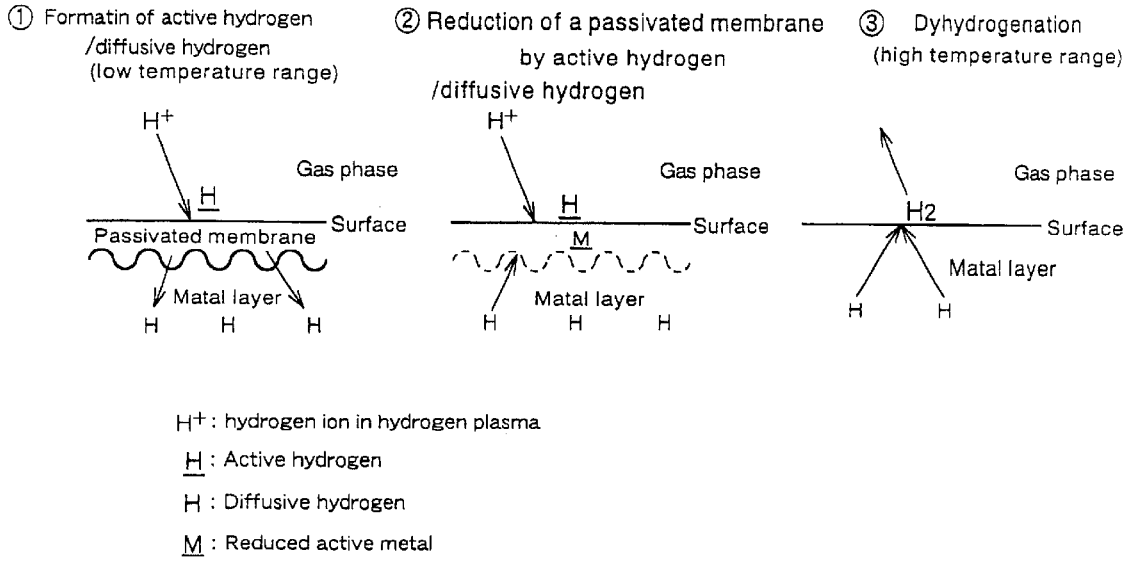
FIG. 3 is a model view showing the action of the passivated membrane removing treatment by hydrogen sputtering.

When a temperature reaches a temperature (normally, 350° C. or higher) at which a reduction reaction is possible, active hydrogen (H) converted from hydrogen ion ($H^+$) in plasma is moved from the surface side to the substarate surface side and, at the same time, diffusive hydrogen (H) in a substrate metal layer is moved to the substrate surface side by raising temperature, and reduces a passivated membrane (metal oxide) from the interior to convert into reduced active metal, respectively (FIG. 3 ↑). Therefore, it makes possible removal of a firm passivated membrane which was previously considered to be difficult by hydrogen sputtering. $H_2O$ produced by hydrogen reduction of a passivated membrane is discharged from the system.

Further, since the system is in a high temperature range after removal of a passivated membrane (reduction of a metal oxide) is almost completed and until the nitriding treatment is initiated, excess diffusive hydrogen (H) in a metal layer is dehydrogenated ($H_2$) and discharged from the system (FIG. 3 →). Therefore, there is no possibility that hydrogen brittleness is generated in metal layer.

This hydrogen sputtering is performed while supplying a gas (hydrogen) to be ionized to a plasma nitriding furnace as in the previous argon sputtering. And, ionization of a hydrogen gas by glow discharge is possible from a low temperature different from the case of an argon gas.

When hydrogen sputtering is performed in the high temperature gas atmosphere at about 350 to 600° C., active hydrogen (H) which entered a metal layer can not stay as active hydrogen and, the system reaches a temperature range where a reduction reaction with hydrogen is possible, it can not contribute to reduction from the inner side of a passivated membrane.

That is, hydrogen becomes to escape from the system easily as an atmospheric temperature grows (molecular weight is about 1/20 that of argon) and, rather, the effect of hydrogen sputtering tends to decrease.

In addition, when an atmospheric temperature grows higher, the surface of an alloy is oxidized and a passivated membrane changes into thicker and firmer one and, thus, it becomes difficult to remove a passivated membrane. This is because the vacuum degree of plasma nitriding treatment is usually not as high as 130 to 1300 Pa, and oxygen is contained in a nitriding furnace at such an amount that can contribute to formation of a passivated membrane ($O_2$ content:0.26 to 2.6%).

An example of the conditions for the hydrogen sputtering is as follows:

- Current:1 to 60A, desirably 30 to 50A
- Voltage:100 to 800V, desirably 200 to 300V
- Vacuum degree (pressure in a furnace):10 to 650 Pa, desirably 10 to 130 Pa
- $H_2$ gas flow rate:0.15 to 3.0 L/min, desirably 0.8 to 1.5 L/min
- Raising rate of a temperature of a processing subject:1 to 20° C./min, desirably 3 to 5° C./min
- Sputtering time:0.5 to 3 h, desirably 1 to 2 h (provided that, until initiation of nitriding treatment and during plasma nitriding treatment, since hydrogen is flown therein at the same time as described above, hydrogen sputtering continues)

When removal treatment is performed outside the above conditions, scatter occurs in removal of a passivated membrane and there is a possibility that a better nitrided layer is not formed.

Current may be direct format (DC) or high frequency format (RF) and one of them may be appropriately utilized.

(3) Plasma Nitriding Treatment

Subsequent to the passivated membrane removing treatment, plasma nitriding treatment is performed.

This nitriding treatment is initiated usually during temperature rising, that is, at a point where a temperature of a processing subject reaches 350 to 450° C., as shown in FIG. 2. When it is initiated at a too low temperature, primary (initial) formation of a nitrided layer occurs before removal of a passivated membrane with hydrogen (by reduction of a metal oxide) is sufficiently performed, and it is difficult to obtain a nitrided layer of stable quality. Conversely, when an initiation temperature is too high, a rate of forming a passivated membrane and that of forming a nitrided layer are competed and primary formation (initial formation) of a nitrided layer becomes difficult.

Subsequently, a temperature is continuously raised to a temperature at which nitriding occurs rapidly:usually, 450 to 590° C., the system is maintained at that temperature during which nitriding treatment is performed to a predetermined depth. Nitriding treatment is terminated when a temperature reaches at the above temperature, depending upon a kind of an iron group series alloy substrate and the required depth of a nitrided layer.

The present inventors have confirmed as follows: Depending upon a kind of an iron group system alloy substrate, for example, in the case of austenitic stainless steel, a nitrided layer of better and stable quality can be formed by performing primary (initial) formation of a nitrided layer while retaining at around 400° C. for a predetermined period of time and, thereafter, performing secondary formation to deepen a nitrided layer at such a processing subject temperature that nitrided layer formation can be rapidly performed. The upper limit of a temperature for secondary formation of a nitrided layer is usually 590° C. When a temperature exceeds 590° C., an iron group system alloy substrate is transformed, and strain may be produced.

The conditions for plasma nitriding treatment is different depending upon the required surface hardness and nitrided layer depth but an example thereof can be summarized as follows:

- Current:40 to 100A, desirably 30 to 50A
  - Current density:0.2 to 0.7 mA/cm$^2$, desirably 0.3 to 0.6 mA/cm$^2$
  - Voltage:250 to 450V, desirably 200 to 300V
  - Power density:500 to 4000 W/m$^2$, desirably 100 to 3000 W/m$^2$
  - Vacuum degree (pressure in a furnace):40 to 2000 Pa, desirably 100 to 130 Pa
  - Temperature:Primary formation (350 to 450° C., desirably 380 to 420° C.)
    - Secondary formation (450 to 590° C., desirably 480 to 560° C.)
  - $H_2$ gas flow rate:0.5 to 1.0 L/min, desirably 0.6 to 0.8 L/min
  - $N_2$ gas flow rate:1.0 to 2.0 L/min, desirably 1.2 to 1.8 L/min
  - Gas ratio $N_2/H_2$:1/5 to 5/1, desirably 1.5/1 to 2.5/1
  - Treatment time:10 min to 100 h, desirably 30 min to 10 h, more desirably 45 min to 2 h The present method for hardening-treating the surface of a metal product has the following action and effects by the essential features that, in a processing method for nitriding an iron group series alloy substrate (processing subject) by plasma nitriding treatment after passivated membrane removing treatment, the passivated membrane removing treatment is performed by hydrogen sputtering-under reduced pressure, that is, under the atmosphere in which nitrogen is not positively contained. Sufficient removal of a passivated membrane is possible, a nitrided layer of high quality can be stably formed as shown in Examples below and, at the same time, a nitrided layer having the high hardness can be easily obtained.

In addition, one cause for unstable passivated membrane removal as in the conventional passivated membrane removing treatment by argon sputtering is eliminated (the number of factors of inhibiting nitrided layer formation is reduced to two:← vacuum pressure in a nitriding treatment furnace and ↑ degreased status before sputtering treatment), and such the effects are exerted that the nitrided layer of high quality can be stably formed.

Further, when passivated membrane removal by hydrogen sputtering is carried out at the same time in a process of raising a temperature of a processing subject, a processing time can be shortened as a whole.

In addition, a gas used in sputtering for passivated membrane removal is hydrogen, the gas used in passivated membrane removing treatment can be also used for plasma nitriding treatment, and an argon gas supplying means becomes unnecessary, being advantageous from a viewpoint of facilities.

In the present specification, so-called normal plasma nitriding (ion nitriding) has been explained in which nitriding or soft nitriding is carried out using plasma by glow discharge produced between a processing subject as a cathode and an anode in the reduced pressure nitriding atmosphere or soft nitriding atmosphere, but the present invention can be also applied to plasma acid nitriding treatment which is performed in the acid nitriding atmosphere (see JIS B 6915). Also in the plasma acid nitriding treatment, since passivated membrane removing treatment can be carried out at the same time during temperature raising period for nitriding, at least, a whole time for nitriding-processing can be shortened.

As used herein, "soft nitriding" refers to nitriding treatment in which a low carbon steel is treated in the presence of a carbon compound (butane or the like) and nitrogen.

In addition, the relevant prior art for present invention is described in the gazette of JP-B 2-2945, having no effect on inventive step of the present invention.

According to the art described in the above gazette, nitriding treatment is performed in the status where nitrogen is positively contained together with a hydrogen gas, which does not disclose the present passivated membrane treatment by hydrogen sputtering.

EXAMPLE

Example carried out for confirming the effects of the present invention will be explained below together with Comparative Example.

(1) Preparation of Example (Specimen)

Figure 4:
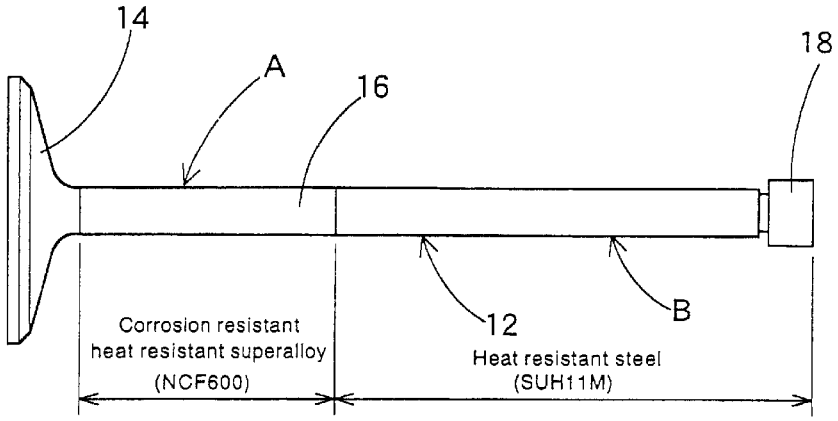
FIG. 4 is a side view of an engine valve which is a processing subject used in Example.

An engine valve (processing subject) 12 consisting of a valve head 14, a valve bar 16 and a valve end 18 as shown in FIG. 4 was subjected to nitriding treatment.

The engine valve having the following material specification was used.

Valve head 14: black skin (iron series alloy: main component Cr and Ni)

From valve head 14 side to an intermediate part of a valve bar 16: corrosion resistant and heat resistant superalloy (NCF600)(main composition:Ni 70%, Cr 18%, Fe main reminder) From an intermediate part to a valve end 18 of a valve bar 16 heat resistant steel (SUH11M) (main composition:Cr 7.5%, Si 2%, Fe reminder)

Figure 5:
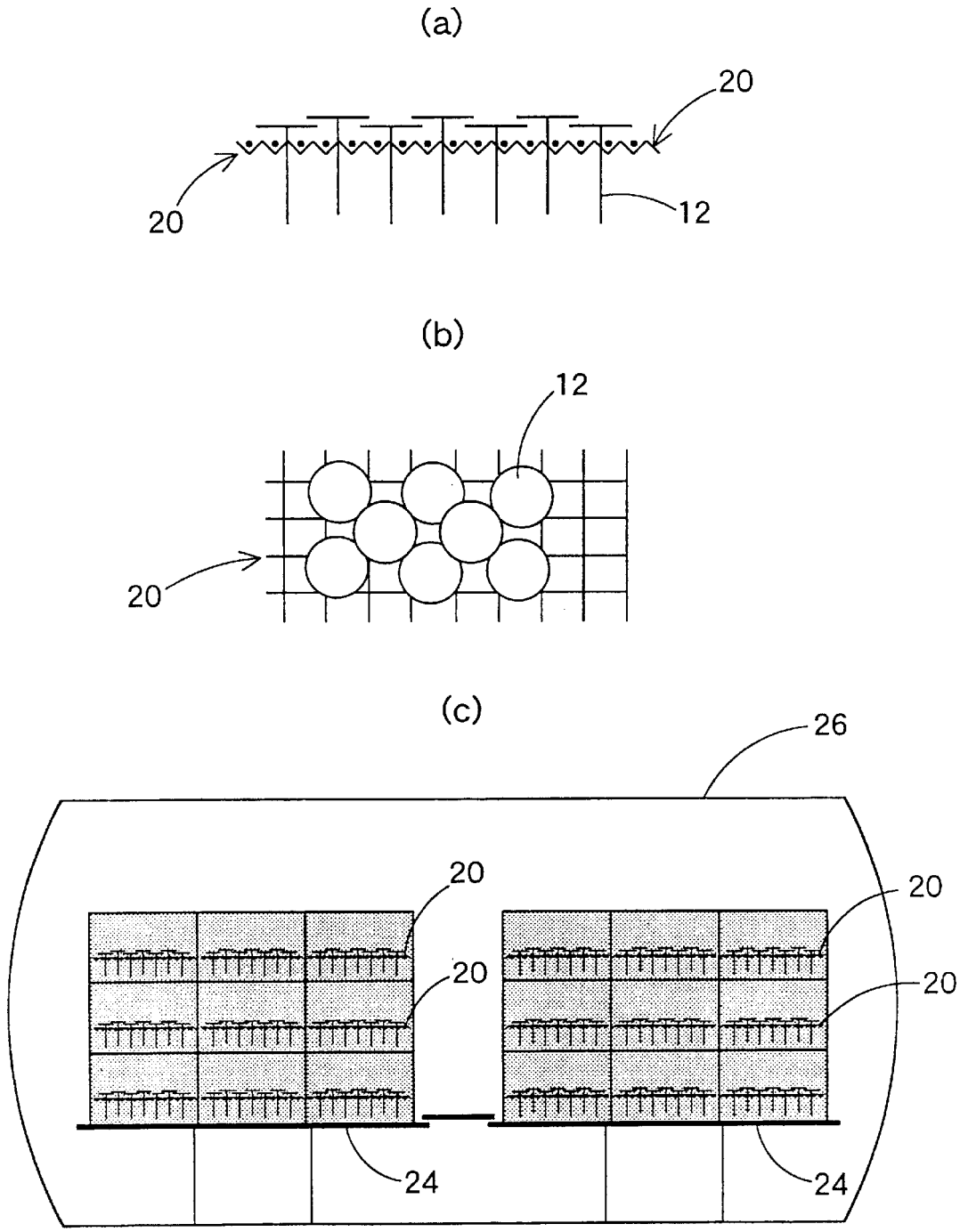
FIG. 5 is a view showing the state where an engine valve in Example is set.

As shown by FIG. 5(*a*) and (*b*), each 222 of processing subjects (specimens:engine valves) 12 having the above specification were set on a specimen stand 20. Thereafter, set stands 20 were piled on a connecting truck 24 in 3 steps and 6 rows to obtain one set (total:3996) as shown in FIG. 5(*c*). After degreasing treatment (trichloroethylene steam washing), each set was placed in a plasma nitriding furnace 26.

After a passivated membrane was removed by hydrogen sputtering, plasma nitriding was performed (see FIG. 2). Nine specimens were extracted at positions corresponding to a measuring position in JIS B 6901 (method for measuring distribution of a temperature of a furnace.

The passivated membrane treatment and the nitriding treatment were carried out under the following conditions using a horizontal plasma nitriding furnace (manufactured and sold by Sem K. K.).

| <Conditions for passivated membrane removing treatment> | |
|---|---|
| Temperature raising rate | 3 ± 1° C./min |
| Hydrogen sputtering time | 2.5h |
| Current | 40 ± 10A |
| Voltage | 250 ± 50V |
| Vacuum degree (pressure in a furnace) | 120 ± 13Pa |
| Hydrogen gas flow rate | 1.5L/min |

| <Conditions for plasma nitriding treatment> | |
|---|---|
| Treatment temperature | |
| (primary formation) | 400° C. |
| (Secondary formation) | 550° C. |
| Treatment time | 1.0h |
| Current | 40 ± 10A |
| Voltage | 250 ± 50V |
| Vacuum degree (pressure in a furnace) | 120 ± 13Pa |
| Hydrogen gas flow rate | 0.7 L/min |
| Nitrogen gas flow rate | 1.5 L/min |

(2) Preparation of Comparative Example (Specimen)

In the Comparative Example, after the same processing subject (engine valve) as that of Example was subjected to passivated membrane removal by argon sputtering as shown in FIG. 1, plasma nitriding treatment was carried out to prepare a specimen.

The conditions were the same as those of Example except for 2 hours as nitriding time provided that, since argon sputtering can not be performed from a normal temperature because of unsatisfied glow discharge conditions, a temperature in a furnace was raised to 550° C. using a heating heater and, thereafter, argon sputtering was initiated. A time for argon sputtering was 0.5 h.

(3) Assessment Test

Concerning each specimen (engine valve) of Example and Comparative Example thus prepared, an assessment test was performed with respect to the following respective terms (the results are expressed as an average of 9).

← Surface Hardness

Vickers hardness (HV) was measured based on JIS G 0563. Pushing weight F was 50 g in a heat resistant steel (SUH11M;hereinafter, same as above) and 200 g in a corrosion resistant and heat resistant superalloy (NCF600; hereinafter, same as above), measuring positions are shown by arrows A and B in FIG. 4.

↑ Nitrided Layer Depth

A photograph of the metal texture was taken at magnification of 1000 using a metal microscope and the depth was obtained based on JIS G 0562.

→ Relationship Between Nitrided Layer Depth and Hardness

A position at 0.02 mm from the surface was measured every 0.05 mm from the surface to the core using a microvickers based on JIS G 0562.

Figure 6:
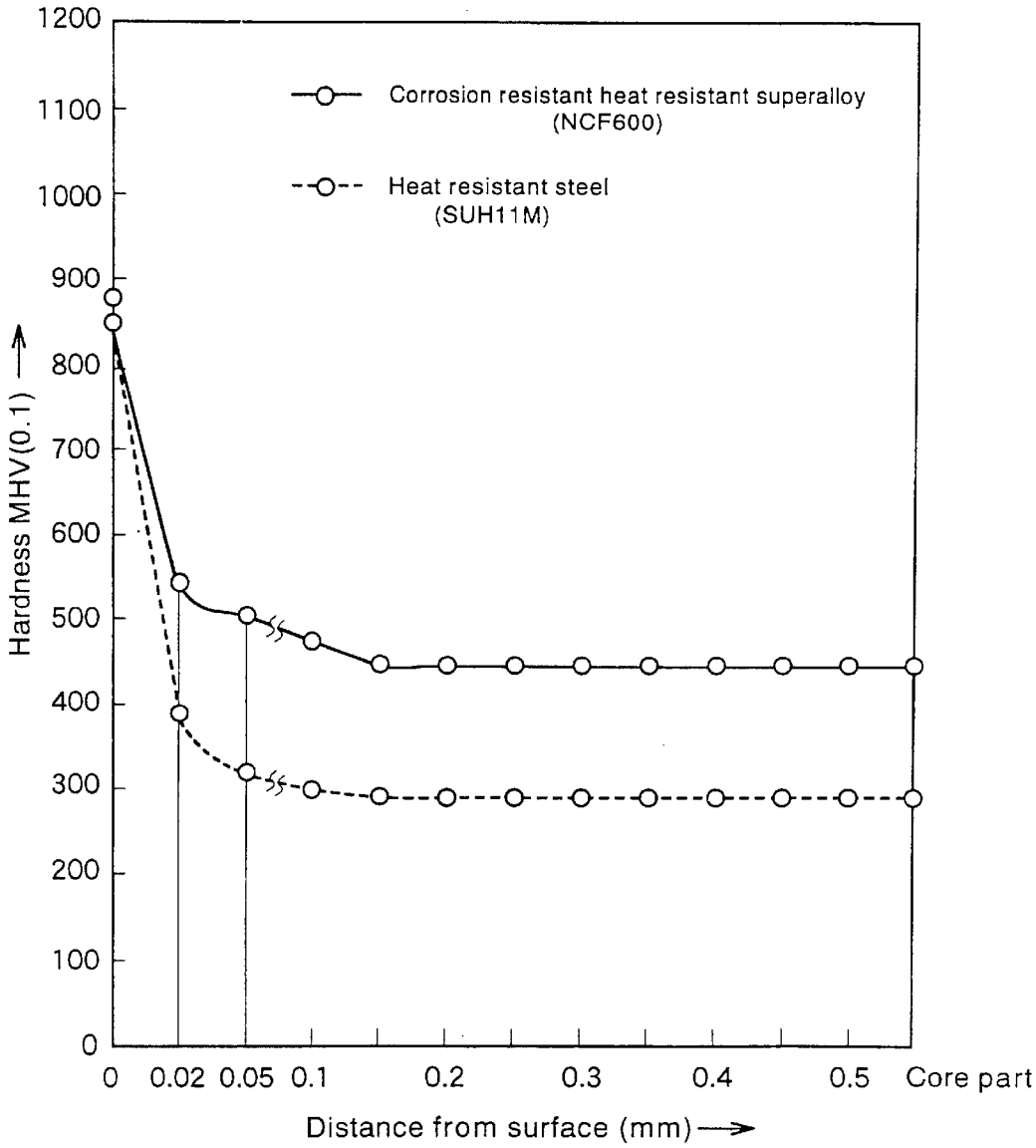
FIG. 6 is a graphical view showing the relationship between a nitrided layer depth and the hardness in Example.
Figure 7:
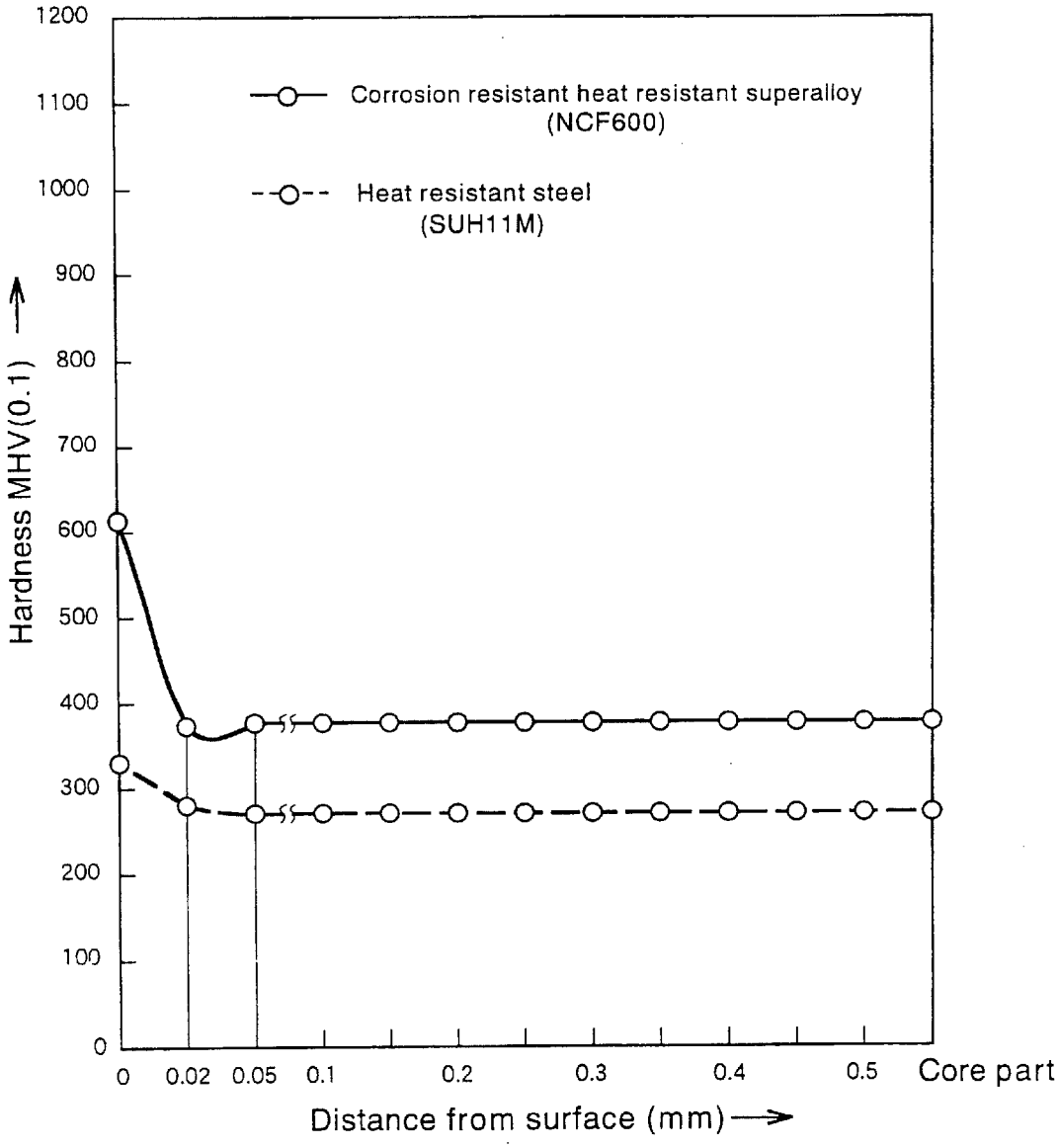
FIG. 7 is a graphical view showing the relationship between a nitrided layer depth and the hardness in Comparative Example.

The relationship between nitrided layer depth and hardness is shown in FIG. 6 regarding Example or in FIG. 7 regarding Comparative Example, respectively.

From these result, it can be seen that in Example using hydrogen sputtering as passivated membrane removing pretreatment, the remarkably high surface hardness is obtained as compared with Comparative Example using argon sputtering. In addition, the nitrided layer depth of Example was about 7 $\mu$m in the case of a heat resistant steel, about 12 $\mu$m in the case of a corrosion resistant heat resistant superalloy, and about 60 $\mu$m in the case of an iron series alloy C, being sufficient.

An uniform nitrided layer was formed in any cases in a metal texture photograph in the case of the present Example.

↓ Test for Confirming Hydrogen Content

Figure 8:
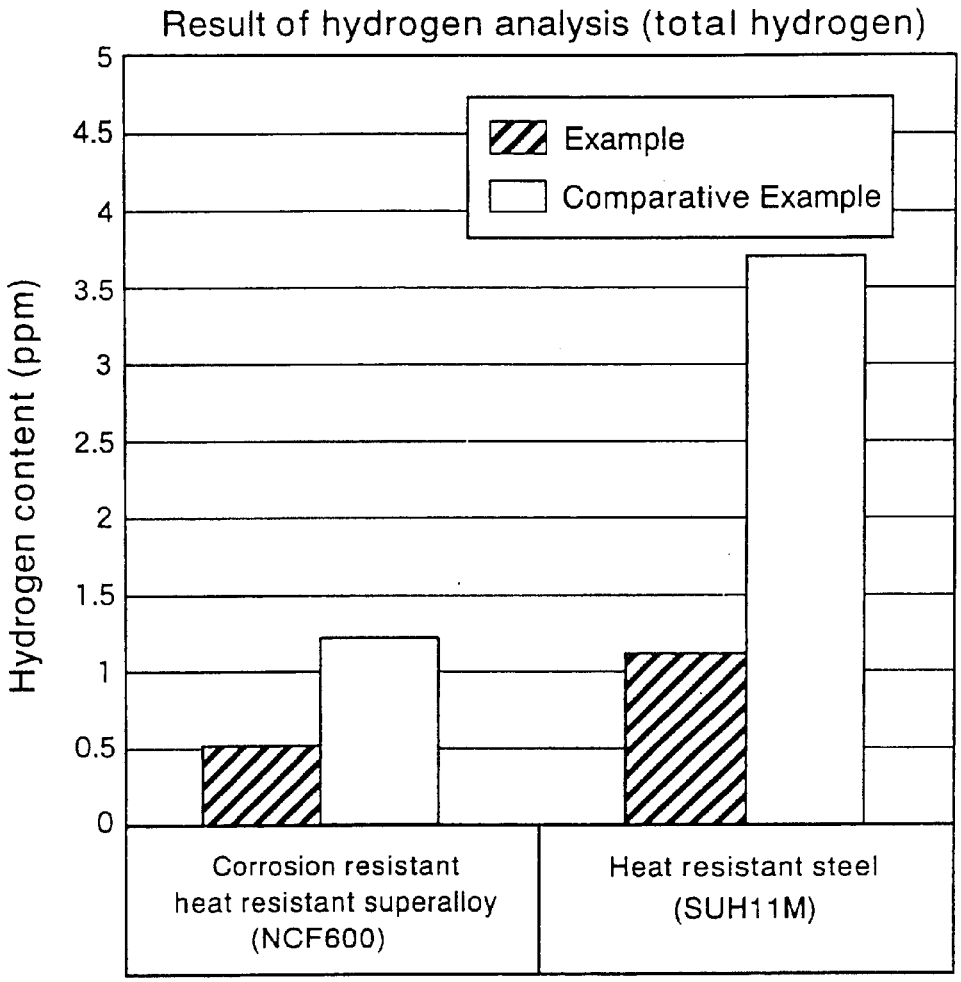
FIG. 8 is a histogram view showing the result of hydrogen content analysis in a metal layer in Example and Comparative Example.

The hydrogen content in a metal layer was measured regarding the above Example and Comparative Example using a tufftriding method based on an iron series material hydrogen quantitating method (JIS Z 2614). From FIG. 8 showing those result, it can be seen that in Example, both heat resistant steel and corrosion resistant heat resistant superalloy have the low hydrogen content as compared with Comparative Example.

° Test for Confirming Hydrogen Brittleness (Tensile Test)

Figure 9:
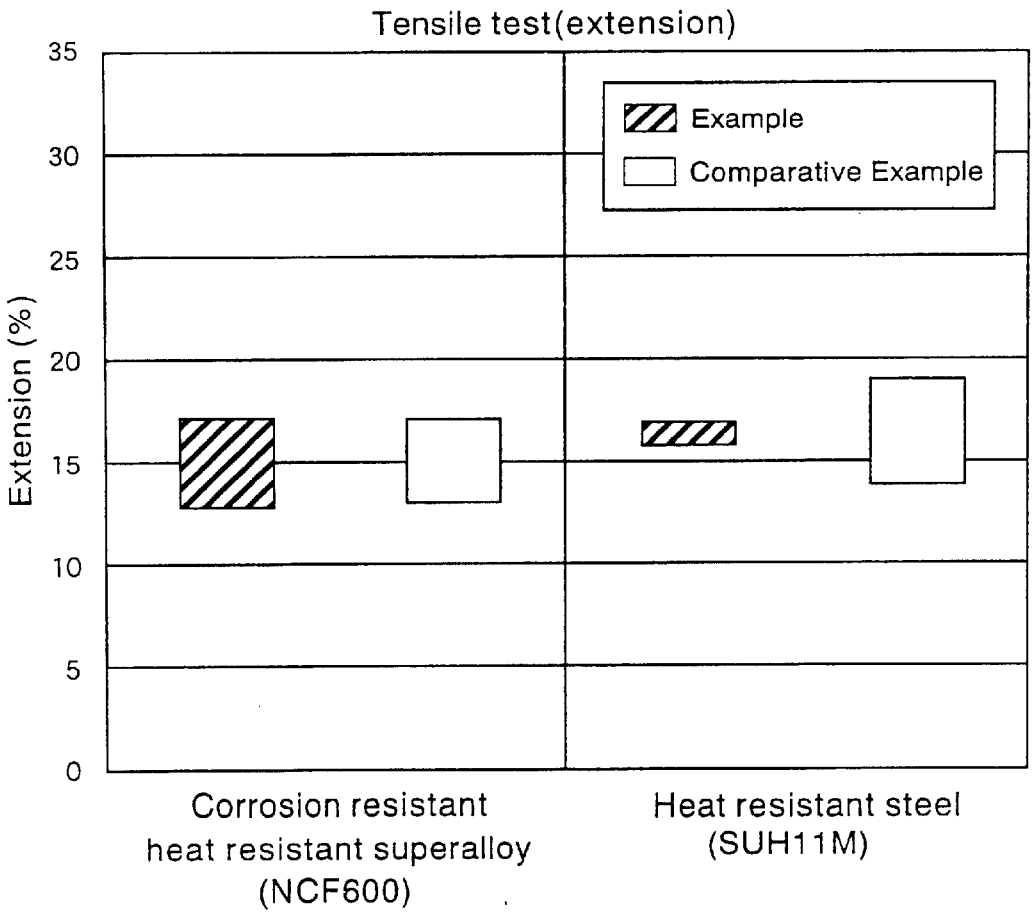
FIG. 9 is a view showing scatter in breaking extension (%) in a tensile test in Example and Comparative Example.
Figure 10:
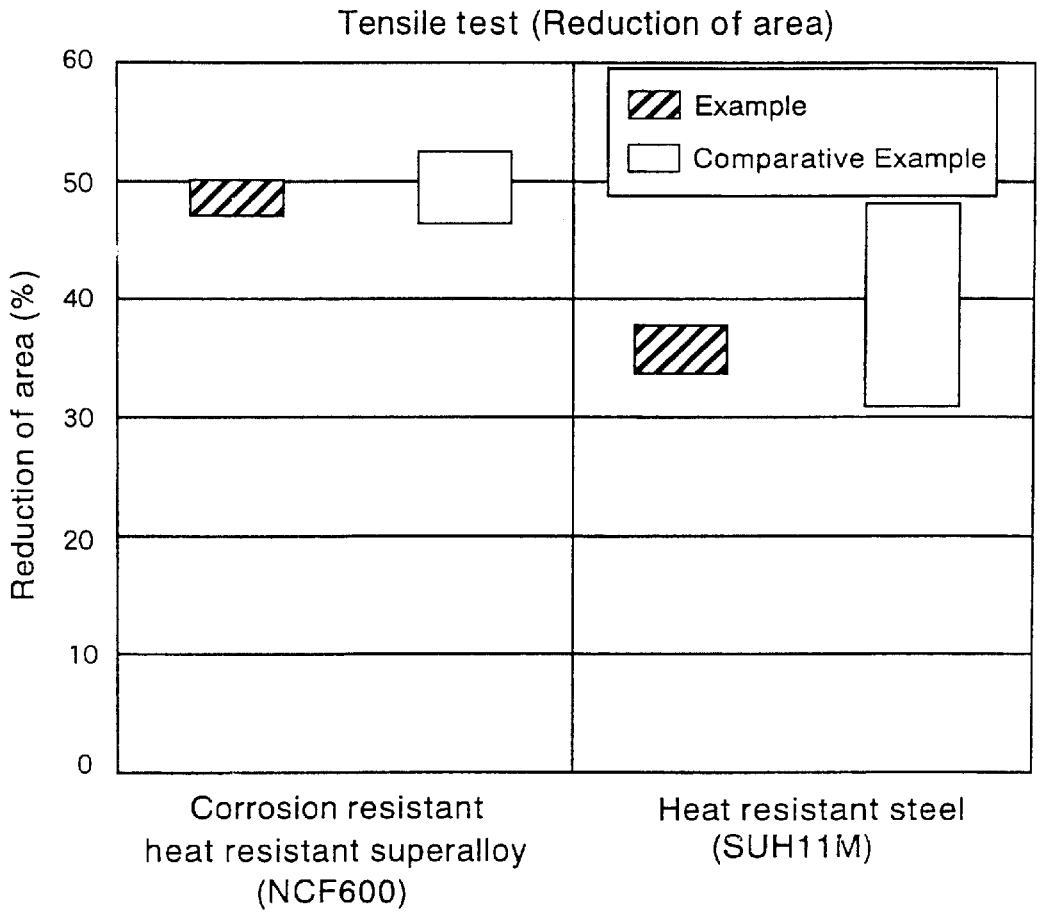
FIG. 10 is a view showing scatter in reduction of area (%) in Example and Comparative Example.

A tensile test was performed regarding the above Example and Comparative Example by a tufftriding method based on JIS Z 2241 (metal material tensile test method). And, breaking extension ($\lambda$) and reduction of area ($\phi$) of each cases were obtained. From FIGS. 9 and 10 showing those result, it can be seen that both heat resistant steel and corrosion resistant heat resistant superalloy of Example show the equal extension ($\lambda$) and reduction of area ($\phi$) as in Comparative Example and had slight effect by hydrogen brittleness and, at the same time, quality scatter is equal or smaller in Example.

What is claimed is:

1. A processing method for nitriding an iron group series alloy substrate, which comprises:

subjecting said substrate to a plasma nitriding treatment after a passivated membrane is removed by a reduction action, wherein said passivated membrane removing treatment is performed by hydrogen sputtering in an atmosphere below about 350° C.

2. The process method for nitriding an iron group series alloy substrate according to claim 1, wherein hydrogen sputtering is performed in an atmosphere below 150° C.

3. The process method for nitriding an iron group series alloy substrate according to claim 2, wherein hydrogen sputtering is performed during a process of raising a temperature of said substrate in a plasma nitriding furnace.

4. The processing method for nitriding an iron group series alloy substrate according to claim 1, which is applied to an iron group series alloy substrate containing chromium as an alloy element at an amount of 3% by mass or more.

5. The processing method for nitriding an iron group series alloy substrate according to claim 4, wherein the iron group series alloy substrate is austenitic.

6. A processing method for nitriding an iron group series alloy substrate, which comprises:

subjecting said substrate to a plasma nitriding treatment after a passivated membrane is removed by a reduction action, wherein a nitrided layer is at least initially formed by the plasma nitriding treatment in an temperature at 350 to 450° C., and said passivated membrane removing treatment is performed by hydrogen sputtering.

7. The processing method for nitriding an iron group series alloy substrate according to claim 6, which is applied to an iron group series alloy substrate containing chromium as an alloy element at an amount of 3% by mass or more.

8. The processing method for nitriding an iron group series alloy substrate according to claim 7, wherein the iron group series alloy substrate is austenitic.

9. The process method for nitriding an iron group series alloy substrate according to claim 6, wherein hydrogen sputtering is performed in an atmosphere below 150° C.

10. The process method for nitriding an iron group series alloy substrate according to claim 9, wherein hydrogen sputtering is performed during a process of raising a temperature of said substrate in a plasma nitriding furnace.

* * * * *

UNITED STATES PATENT AND TRADEMARK OFFICE

CERTIFICATE OF CORRECTION

PATENT NO. : 6,602,353 B1
DATED : August 5, 2003
INVENTOR(S) : Shigeaki Kanbe et al.

It is certified that error appears in the above-identified patent and that said Letters Patent is hereby corrected as shown below:

Column 10,
Line 33, replace "in an temperature at" with -- in the temperature atmosphere at --.

Signed and Sealed this

Twentieth Day of January, 2004

JON W. DUDAS
*Acting Director of the United States Patent and Trademark Office*